US005884784A

United States Patent [19]

Betts, Sr.

[11] Patent Number: 5,884,784

[45] Date of Patent: Mar. 23, 1999

[54] LABORATORY DRYING RACK SYSTEM AND A DISPENSER UNIT THEREFOR

[76] Inventor: Paul J. Betts, Sr., 15487 Linn Ct., Spring Lake, Mich. 49456

[21] Appl. No.: 859,068

[22] Filed: May 20, 1997

[51] Int. Cl.[6] ..... A47F 5/00

[52] U.S. Cl. ..... 211/88.01; 211/87.01; 211/50; 248/905; 206/278

[58] Field of Search ..... 211/88.01, 87.01, 211/71.01, 85.17, 85.13, 75, 50, 49.1; 206/278; 248/905

[56] References Cited

U.S. PATENT DOCUMENTS

| | | | |
|---|---|---|---|
| 2,543,169 | 2/1951 | Hicks . | |
| 2,836,386 | 5/1958 | Iverson . | |
| 2,911,175 | 11/1959 | Erie | 248/905 |
| 3,089,597 | 5/1963 | Kaplan . | |
| 3,168,275 | 2/1965 | Grondin . | |
| 3,489,385 | 1/1970 | Dill . | |
| 3,912,212 | 10/1975 | Betts, Sr. . | |
| 4,485,929 | 12/1984 | Betts, Sr. . | |
| 4,494,661 | 1/1985 | Kvusche | 211/87.01 |
| 4,616,755 | 10/1986 | Adolfsson | 211/50 X |
| 4,677,697 | 7/1987 | Hayes . | |
| 4,997,105 | 3/1991 | Fischer | 206/278 X |
| 5,163,567 | 11/1992 | Betts | 211/75 |

*Primary Examiner*—Robert W. Gibson, Jr.
*Attorney, Agent, or Firm*—Rader, Fishman, Grauer & McGarry

[57] ABSTRACT

A draining laboratory drying rack system comprises a panel having a plurality of apertures formed therein, a plurality of pegs mounted in the apertures for supporting wet laboratory equipment, and a dispensing unit mounted to the panel by hooks on the dispensing unit being received within the apertures. The incorporation of the dispensing unit provides for mounting safety article dispensers within convenient reach of a user.

16 Claims, 3 Drawing Sheets

LABORATORY DRYING RACK SYSTEM AND A DISPENSER UNIT THEREFOR

BACKGROUND OF THE INVENTION

1. Field of the Invention

The invention relates to a draining laboratory drying rack system and, more specifically, to an improved draining laboratory drying rack system with a dispensing unit.

2. Description of the Related Art

In chemical laboratories, medical testing centers, and other facilities wherein glassware and other laboratory equipment is frequently used, drain boards or racks are utilized for holding the wet glassware and equipment to air dry after washing. U.S. Pat. No. 3,779,392, issued Dec. 18, 1973 to Betts, Sr.; U.S. Pat. No. 3,912,212, issued Oct. 14, 1975 to Betts, Sr.; U.S. Pat. No. 4,485,929, issued Dec. 4, 1984 to Betts, Sr.; and U.S. Pat. No. 5,163,567, issued Nov. 17, 1992 to Betts, Sr. disclose a lightweight laboratory drain board formed from sheet material with pegs extending from the board to support laboratory equipment thereon. The laboratory drain boards or panels can be wall mounted or freestanding. Pegs are selectively received in apertures of the board. In the Betts, Sr. '392 patent, the pegs are secured to the board by slip nuts. The pegs of the Betts, Sr. '212 and Betts, Sr. '929 patents are provided with an enlarged head having a smaller neck portion which is inserted through the aperture and subsequently slide downward into place to thereby lock the peg onto the drain board. In the Betts, Sr. '212 patent, T-shaped pegs are used in T-shaped apertures, and in the Betts, Sr. '929 patent, triangular-shaped pegs are mounted in triangular-shaped apertures. In the Betts, Sr. '567 patent, a catch drain is provided on the rear surface of the board to collect and remove any liquid that collects or seeps onto the rear surface of the board.

Laboratory draining rack systems, such as those disclosed in the various Betts, Sr. patents discussed above, are widely used in medical testing and research facilities. Several of these facilities are conducting research and tests on highly contagious and deadly viruses, such as the HIV virus which is the cause of Acquired Immune Disease Syndrome (AIDS). Not surprisingly, the laboratory workers exposed to such viruses on a daily basis are very safety conscious in their handling of the viruses and the cleaning the laboratory and laboratory equipment to prevent contamination or exposure. Given the repeated contact with highly contagious or deadly viruses, there is a need to provide the user of the draining rack system with a convenient dispenser for safety articles, such as gloves and masks, for example.

SUMMARY OF INVENTION

The draining laboratory drying rack system according to the invention overcomes the problems of the prior art system by incorporating a dispensing unit on the drying rack system. The dispensing unit preferably provides safety articles, such as gloves and masks, for convenient access by a laboratory technician using the draining laboratory rack system.

The drying rack system according to the invention is used for supporting a variety of pieces of laboratory equipment. The drying rack system comprises a panel having a front surface, a rear surface, and at least one panel aperture extending through the panel. A dispensing unit is mounted to the panel via the aperture to provide a dispenser, easily accessible to a user, for dispensing safety articles.

In the preferred embodiment, the dispensing unit comprises a housing having a rear wall with at least one hook which is received within the aperture to mount the dispensing housing to the panel. The dispensing housing is adapted to receive a dispenser of safety articles. The hook is preferably a biased T-hook which compressively holds the housing to the panel by the spring force of the biased T-hooks.

BRIEF DESCRIPTION OF THE DRAWINGS

The invention will now be described with reference to the drawings wherein.

DESCRIPTION OF THE PREFERRED EMBODIMENT

Figure 1:
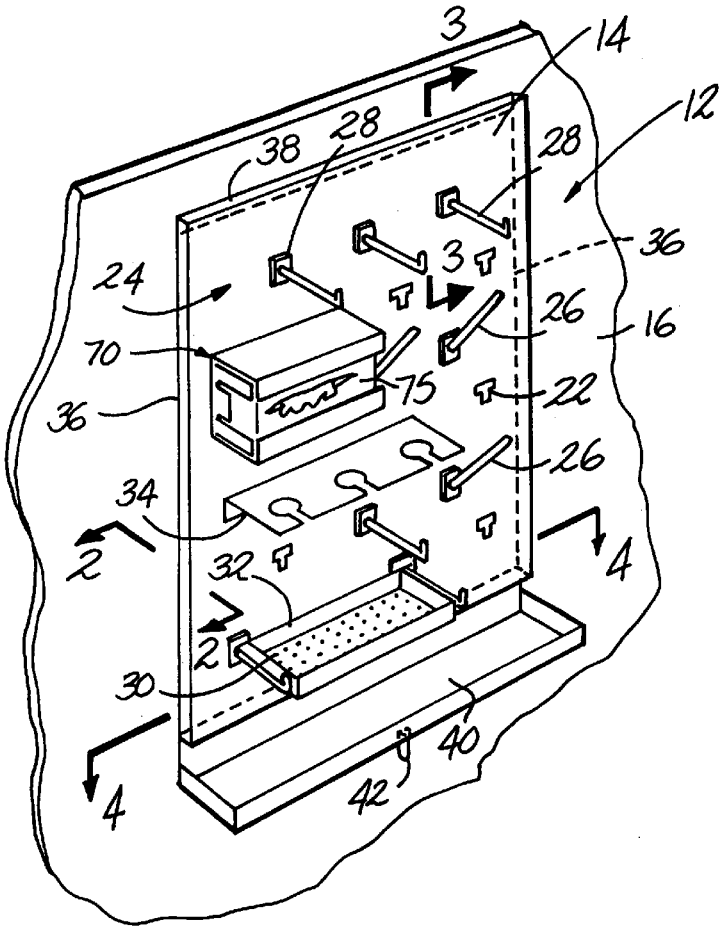
FIG. 1 is a left, perspective view of the draining laboratory drying rack system according to the invention.
Figure 2:
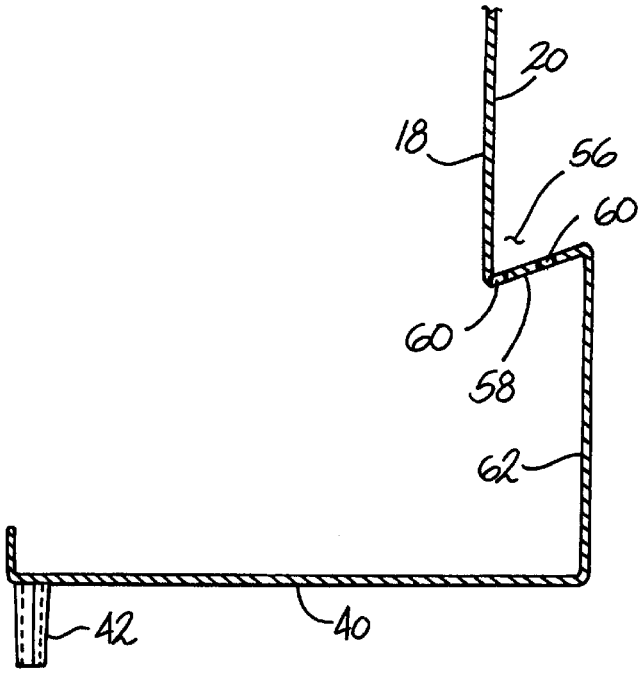
FIG. 2 is a partial, sectional view of the drainage trough taken along lines 2—2 of FIG. 1.

Referring now to the drawings and to FIG. 1 in particular, a laboratory drying rack system 12 includes a panel 14 adapted to be mounted to a wall 16. The panel 14 has a front surface 18 (FIG. 2) and a rear surface 20 (FIG. 2). At least one panel aperture 22 is formed in the panel 14. The panel 14 includes a plurality of pegs 24 including slanted pegs 26 and horizontal support pegs 28 which are releasably secured to the panel aperture 22. The pegs 24 are easily removable and replaceable to permit cleaning of the pegs 24 and the panel 14.

The pegs 24 can be mounted to the panel 14 in one of several different manners. Examples of suitable mounting structures are seen in U.S. Pat. No. 3,779,392, issued Dec. 18, 1973 to Betts, Sr.; U.S. Pat. No. 3,912,212, issued Oct. 14, 1975 to Betts, Sr.; U.S. Pat. No. 4,485,929 issued Dec. 4, 1984 to Betts, Sr.; and U.S. Pat. No. 5,163,567, issued Nov. 17, 1992 to Betts, Sr. Each of these prior Betts, Sr. patents are expressly incorporated herein by reference.

The slanted pegs 26 typically hold tubes, bottles, or other laboratory equipment thereon. The support pegs 28 are generally normal to the front surface 18 of the panel 14 and are adapted to mount a variety of utensil support articles which serve to hold various types of laboratory equipment including funnels, pipettes, mixing bowls, slides, bottle stoppers, tubing, etc. The support pegs 28 enable the system 12 to be equipped with a variety of utensil support articles. Specifically, a drain basket 30 and drain shelf 32 provide means for holding larger, irregular-shaped equipment, allowing the equipment to air dry, and a funnel rack 34 serves as a means to hold a funnel in an upright position for air drying.

The panel 14 is provided with sidewalls 36 and a rearwardly-extending top wall 38. The sidewalls 36 of the panel 14 are formed by bending the sides of the panel 14 at a 90 degree angle relative to the front surface 18 thereof. The top wall 38 is formed by bending the top of the panel 14 into an L-shaped configuration having a rearwardly-extending flange 38 and a downwardly extending mounting flange 52

Figure 3:
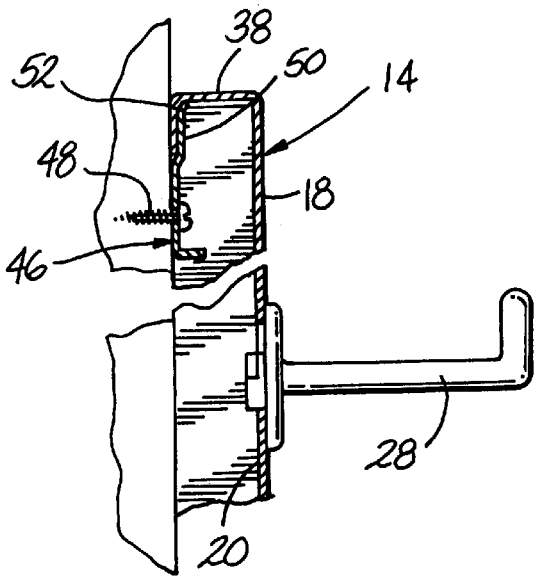
FIG. 3 is a partial, sectional view of the wall mounting bracket taken along lines 3—3 of FIG. 1.
Figure 4:
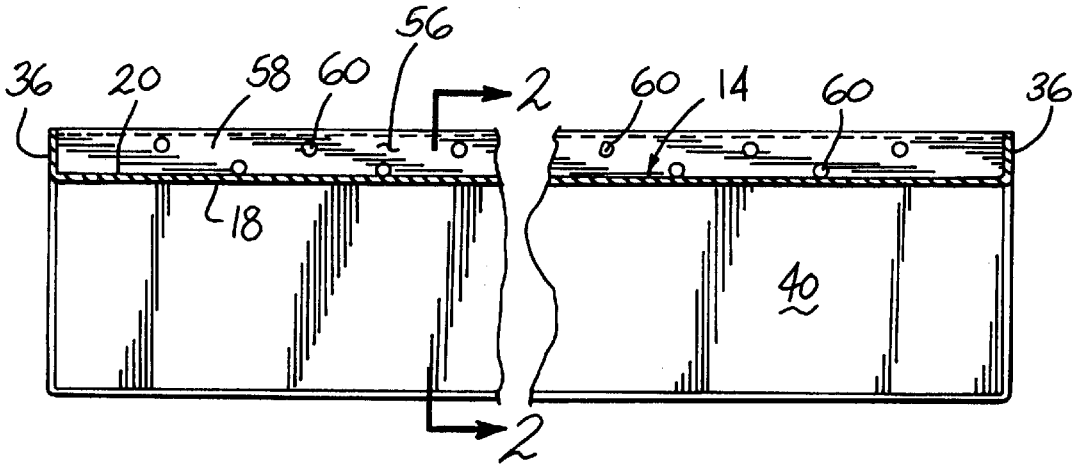
FIG. 4 is a sectional view of the catch drain taken along lines 4—4 of FIG. 1.

(FIG. 3). A drip trough 40 is preferably mounted along the bottom edge of the panel 14 and extends outwardly from the front surface 18 a short distance to collect liquid which can drip from the various pieces of laboratory equipment supported on the pegs 24 or utensil support articles or which can drip down the front surface 18 of the panel 14. Preferably, the drip trough 40 has a drain tube 42 connected to the lowest point of the drip trough 40 to channel any liquid in the trough 40 to a suitable disposal means such as a sink. The liquid will naturally flow to the lowest point of the trough 40 by the force of gravity.

The laboratory drying rack system 12 is preferably mounted to the wall above or adjacent to the sink in which the laboratory equipment is being washed. As seen in FIG. 3, a wall mounting bracket is securely fastened to the wall 16 by a plurality of fasteners 48. The wall mounting bracket 46 has an upwardly extending offset flange 50 which is spaced from the wall 16 a short distance. The panel 14 is mounted in place against the wall 16 by inserting the downwardly extending mounting flange 52 of the panel 14 into the space between the offset flange 50 of the mounting bracket 46 and the wall 14. The mounting bracket 46 can extend the width of the panel 14 or, alternatively, two or more shorter brackets can be employed. Thus, the mounting bracket 46 allows for easy removal and replacement of the panel 14 for cleaning.

If it is not desired to mount the panel 14 to the wall, a portable drying rack can alternatively be provided as described in U.S. Pat. No. 4,485,929, issued Dec. 4, 1984 to Betts, Sr.

A catch drain 56 is provided on the rear surface 20 of the panel 14 to collect any liquid which can collect or flow down the rear surface 20 of the panel and preferably channel the liquid into the drip trough 40 for proper disposal. If all of the apertures 22 of the panel 14 are not provided with a peg 24, liquid may seep through the open panel apertures 22 to the rear surface of the panel 20. Alternatively, if a peg 24 is not correctly mounted in the aperture 22, liquid can seep to the rear surface 20 of the panel 14. As best seen in FIG. 2, the catch drain 56 comprises an upwardly directed flange 58 extending toward the wall 16. The flange 58 preferably creates an acute angle with the rear surface 20 of the panel 14.

A plurality of catch drain apertures 60 are formed in the flange 58, and the catch drain 56 spans the entire width of the panel 14. Any liquid which drains down the rear surface 20 of the panel 14 is initially collected in the catch drain 56 and then passes through the catch drain apertures 60 into the drip trough 40. A first row of catch drain apertures are mounted immediately adjacent the junction between the flange 58 and the bottom edge of the panel 14, and a second row of apertures 60 are formed a spaced distance from the first row.

As seen in FIG. 2, the drip trough 40 is mounted immediately below the catch drain 56. The drip trough 40 is preferably supported by the catch drain 56 and a vertical support member 62. Similar to the formation of the sidewall and top wall 38 of the panel, the catch drain 56, vertical support member 62, and drip trough 40 are preferably formed by manipulating a single piece of sheet material, such as stainless steel, into the desired shape.

Figure 5:
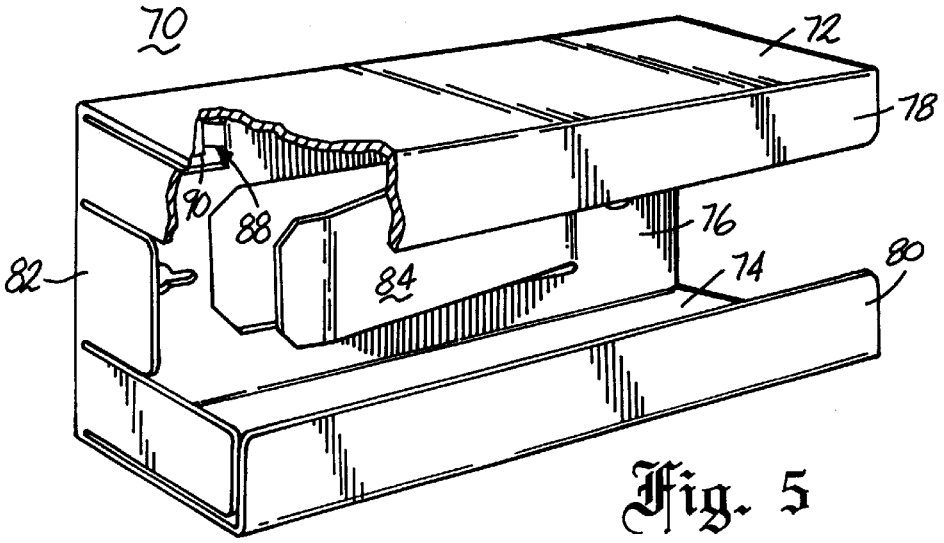
FIG. 5 is a perspective view of a dispensing unit according to the invention.
Figure 6:
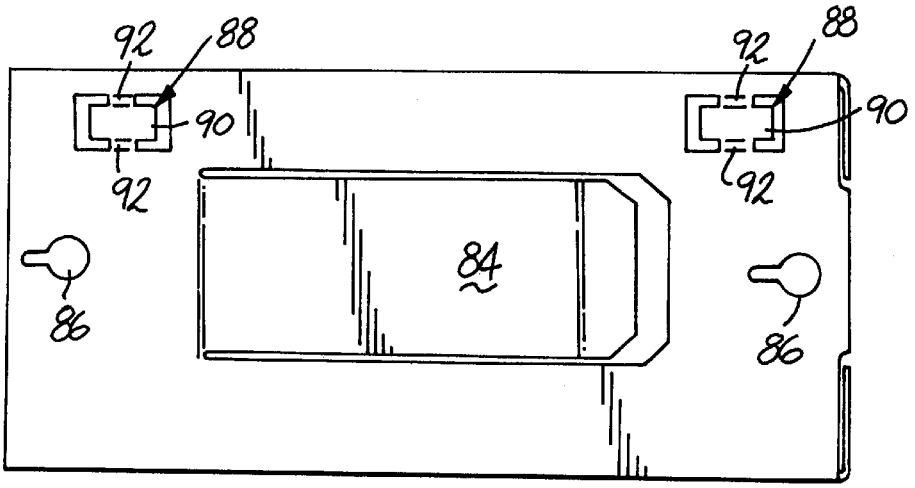
FIG. 6 is a rear view of the dispensing unit of FIG. 5.
Figure 7:
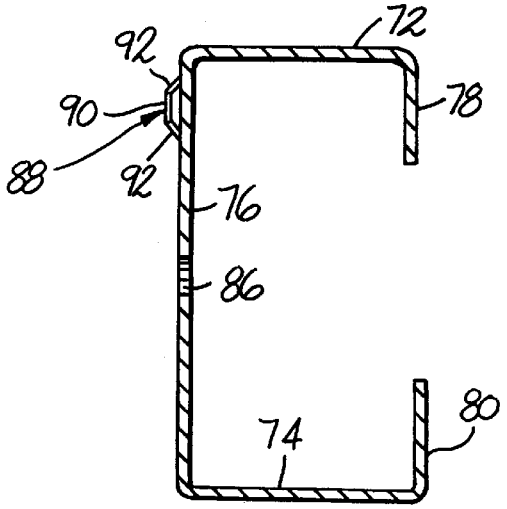
FIG. 7 is a sectional view taken along lines 7—7 of FIG. 6.

FIGS. 5–7 illustrate a dispensing unit 70 according to the invention. The dispensing unit 70 comprises a housing having a generally planar top wall 72 and bottom wall 74 connected by a rear wall 76. Peripheral flanges 78, 80, and 82 are provided on the front and left sides (as seen in FIG. 5) of the top wall 72 and bottom wall 74 and along the left side (as seen in FIG. 5) of the rear wall 76. The peripheral flanges 78, 80, and 82 effectively close off the left side and front of the dispensing unit 70 while leaving open the right side. In this manner, a safety article dispenser 75 can be slidably inserted into the right-hand side of the dispensing unit 70. A suitable safety article dispenser 75 can include a dispenser for dispensing surgical gloves, surgical masks, towelettes, and the like.

The rear wall 76 further comprises a plate spring 84, mounting apertures 86, and biased T-hooks 88. The plate spring 84 is preferably stamped from the rear wall and bent inwardly into the housing. In this manner, the plate spring 84 will bias the safety article dispenser 75 against the top and bottom peripheral flanges 78 and 80 to securely hold the safety article dispenser 75 within the dispensing unit 70.

The mounting apertures are optional and not necessary for using the invention. The mounting apertures 86 provide an alternative mounting for the dispensing unit 70 by receiving hooks or similar items already previously mounted onto the panel 14.

The biased T-hooks 88 further comprise a planar hook portion 90 connected to the rear wall 76 by the spring webs 92. The planar hook portion 90 lies generally in a plane that is parallel to the rear surface of the rear wall 76 and offset therefrom a predetermined distance. Preferably, the offset distance is such that the gap between the planar hook portion 90 and the rear wall 76 is slightly less than the thickness of the panel 14. Thereby, when the dispensing unit 70 is mounted to the panel 14, the planar hook portion 90 must be sprung slightly away from the rear wall 76 by springing the spring webs 92 to receive the panel 14. The spring force in the spring webs 92 will compress the panel between the planar hook portion 90 and the rear wall 76 to compressively hold the dispensing unit 70 to the panel 14, securely mounting the dispensing unit 70 to the panel 14.

Preferably, the dispensing unit 70 is made from a single piece of stainless steel. The plate spring 84, mounting apertures 86, and biased T-hooks 88 are all made by stamping a flat sheet of stainless steel. The peripheral flanges 78, 80, and 82 are formed by bending the respective portions of the stainless steel sheet. Finally, the top wall 72, bottom wall 74, and rear wall 76 are also formed by bending the stainless steel sheet. In this manner, a convenient and securely mountable dispensing unit 70 can be simply made.

Although the safety article dispenser 75 is illustrated as being physically separate from the dispensing unit 70, it is within the scope of the invention for the dispensing unit 70 and the safety article dispenser 75 to be a unitary structure. The unitary structure would not require the plate spring 84. The unitary structure also provides the benefit of a disposable dispensing unit or a recyclable dispensing unit.

Medical workers and laboratory technicians are exposed daily to extremely hazardous and life threatening viruses. Therefore, it is imperative that equipment used in testing and research be thoroughly cleaned and sterilized. It is also important that the laboratory drying rack system is capable of mounting a dispenser unit for dispensing the safety articles to eliminate and minimize laboratory and medical worker's exposure to the hazardous viruses. The laboratory drying rack system according to the invention provides a safe, clean, and efficient way to support laboratory equipment, to clean and sterilize the drying rack system itself, and to provide a safety article dispensing unit. The laboratory drying rack according to the invention provides a safer laboratory environment for such workers.

While particular embodiments of the invention have been shown, it will be understood, of course, that the invention is not limited thereto since modifications can be made by those skilled in the art, particularly in light of the foregoing teachings. Reasonable variation and modification are possible within the foregoing disclosure of the invention without departing from the spirit of the invention.

The embodiments for which an exclusive property or privilege is claimed are defined as follows:

1. A laboratory drying rack system for supporting a variety of pieces of laboratory equipment comprising a panel having a front surface and a rear surface, at least one panel aperture extending through the panel, and a dispensing unit for dispensing safety articles and having at least one hook adapted to be received within the at least one panel aperture to mount the dispensing unit to the at least one panel.

2. A laboratory drying rack system according to claim 1 wherein the dispensing unit comprises a housing with a top wall and a bottom wall connected by a rear wall and the at least one hook extending from the rear wall.

3. A laboratory drying rack system according to claim 2 wherein at least one of the top wall, bottom wall, and rear wall has a peripheral flange effectively closing off all but one side of the housing to define an open side of the housing.

4. A laboratory drying rack system according to claim 3 wherein the dispensing unit further comprises a safety article dispenser adapted to be received within the open side of the housing.

5. A laboratory drying rack system according to claim 3 wherein the safety article dispenser is a surgical glove dispenser.

6. A laboratory drying rack system according to claim 2 wherein the dispensing unit further comprises a safety article dispenser positioned within the housing.

7. A laboratory drying rack system according to claim 6 wherein the rear wall further comprises a spring to compressively hold the safety article dispenser within the housing.

8. A laboratory drying rack system according to claim 1 wherein the hook comprises a planar hook portion disposed rearwardly from the rear wall and at least one spring web connecting the planar hook portion to the rear wall, wherein the planar hook portion is received within the at least one aperture to mount the dispensing unit to the panel.

9. A laboratory drying rack system according to claim 8 wherein the distance between the planar hook portion and the rear wall is less than the thickness of the panel, wherein when the hook is mounted within the at least one aperture, and the at least one spring web is sprung and applies a spring force against the back of the panel, compressing the panel between the planar hook portion and the rear wall to compressively mount the dispensing unit to the panel.

10. A laboratory drying rack system according to claim 9 wherein the hook has two opposing spring webs.

11. A laboratory drying rack system according to claim 10 wherein the dispensing unit has two hooks.

12. A dispensing unit for a laboratory drying rack system comprising:

a panel having a front surface and a rear surface;

at least one panel aperture extending through the panel;

the dispensing unit comprising a housing with a top wall and a bottom wall connected by a rear wall;

at least one hook extending from the rear wall adapted to be received within the at least one aperture to mount the dispensing unit to the at least one panel; and wherein the hook comprises a planar hook portion disposed away from the rear wall and at least one spring web connecting the planar hook portion to the rear wall, wherein the planar hook portion is received within the at least one aperture to mount the dispensing unit to the panel.

13. A dispensing unit according to claim 12 wherein the at least one of the top wall, bottom wall, and rear wall has a peripheral flange effectively closing off all but one side of the housing to define an open side of the housing.

14. A dispensing unit according to claim 13 wherein the dispensing unit further comprises a safety article dispenser adapted to be received within the open side of the housing.

15. A dispensing unit according to claim 13 wherein the safety article dispenser is a surgical glove dispenser.

16. A dispensing unit according to claim 11 wherein the distance between the planar hook portion and the rear wall is less than the thickness of the panel, wherein when the hook is mounted within the at least one aperture, the at least one spring web is sprung and applies a spring force against the back of the panel, compressing the panel between the planar hook portion and the rear wall, to compressively mount the dispensing unit to the panel.

* * * * *

UNITED STATES PATENT AND TRADEMARK OFFICE

CERTIFICATE OF CORRECTION

PATENT NO.: 5,884,784

DATED: March 23, 1999

INVENTOR(S): Paul J. Betts, Sr.

It is certified that error appears in the above-identified patent and that said Letters Patent is hereby corrected as shown below:

Claim 16, col. 6, line 37, "11" should read --12--.

Signed and Sealed this

Thirty-first Day of August, 1999

*Attest:*

Q. TODD DICKINSON

*Attesting Officer*

*Acting Commissioner of Patents and Trademarks*